US010145562B1

(12) United States Patent
Swanson et al.

(10) Patent No.: US 10,145,562 B1
(45) Date of Patent: Dec. 4, 2018

(54) STEAM BASED FAUX FIREPLACE

(71) Applicants: Jason Swanson, Tempe, AZ (US); David Daniel, Scottsdale, AZ (US); Jeff Doss, Scottsdale, AZ (US); Josh Wedge, Scottsdale, AZ (US)

(72) Inventors: Jason Swanson, Tempe, AZ (US); David Daniel, Scottsdale, AZ (US); Jeff Doss, Scottsdale, AZ (US); Josh Wedge, Scottsdale, AZ (US)

(73) Assignee: MODERN FLAMES, LLC, Phoenix, AZ (US)

( * ) Notice: Subject to any disclaimer, the term of this patent is extended or adjusted under 35 U.S.C. 154(b) by 0 days.

(21) Appl. No.: 15/966,509

(22) Filed: Apr. 30, 2018

Related U.S. Application Data

(63) Continuation-in-part of application No. 15/687,284, filed on Aug. 25, 2017, now Pat. No. 10,018,362.

(51) Int. Cl.
*F24C 13/00* (2006.01)
*F24B 1/18* (2006.01)

(52) U.S. Cl.
CPC ..... *F24B 1/1808* (2013.01)

(58) Field of Classification Search
USPC ..... 126/500; 40/428
See application file for complete search history.

(56) References Cited

U.S. PATENT DOCUMENTS

| | | | | |
|---|---|---|---|---|
| 5,374,191 | A * | 12/1994 | Herman | A62C 99/0081 434/226 |
| 6,691,440 | B1 * | 2/2004 | Petz | F24C 7/004 392/348 |
| 7,762,897 | B2 * | 7/2010 | Starr | F21S 10/04 40/427 |
| 7,909,113 | B1 * | 3/2011 | Campos | A62C 3/00 126/500 |
| 2006/0275721 | A1 | 12/2006 | Starr et al. | |
| 2010/0031543 | A1 * | 2/2010 | Rice | F24C 7/004 40/428 |

FOREIGN PATENT DOCUMENTS

| | | |
|---|---|---|
| CN | 104 748 199 | 7/2015 |
| GB | 2436212 A | 9/2007 |
| GB | 2460453 A | 12/2009 |
| WO | WO 03/063664 A1 | 8/2003 |
| WO | WO 2009/034021 A2 | 3/2009 |

* cited by examiner

*Primary Examiner* — Avinash Savani
(74) *Attorney, Agent, or Firm* — Colhane Meadows PLLC; Robert C. Klinger

(57) ABSTRACT

A steam-based faux fireplace comprising a boiler configured to receive a fluid and generate steam, and a manifold configured to receive the steam from the boiler and emit the steam to generate a steam plume at an output. A very realistic faux flame with a significant length is generated from the low power boiler. The manifold includes a deflector configured to receive directly impinging steam directed thereat from the output, causing the steam to lose some energy and velocity, and turbulently billow about the deflector. The turbulently billowing steam is illuminated to create a realistically looking flame.

16 Claims, 13 Drawing Sheets

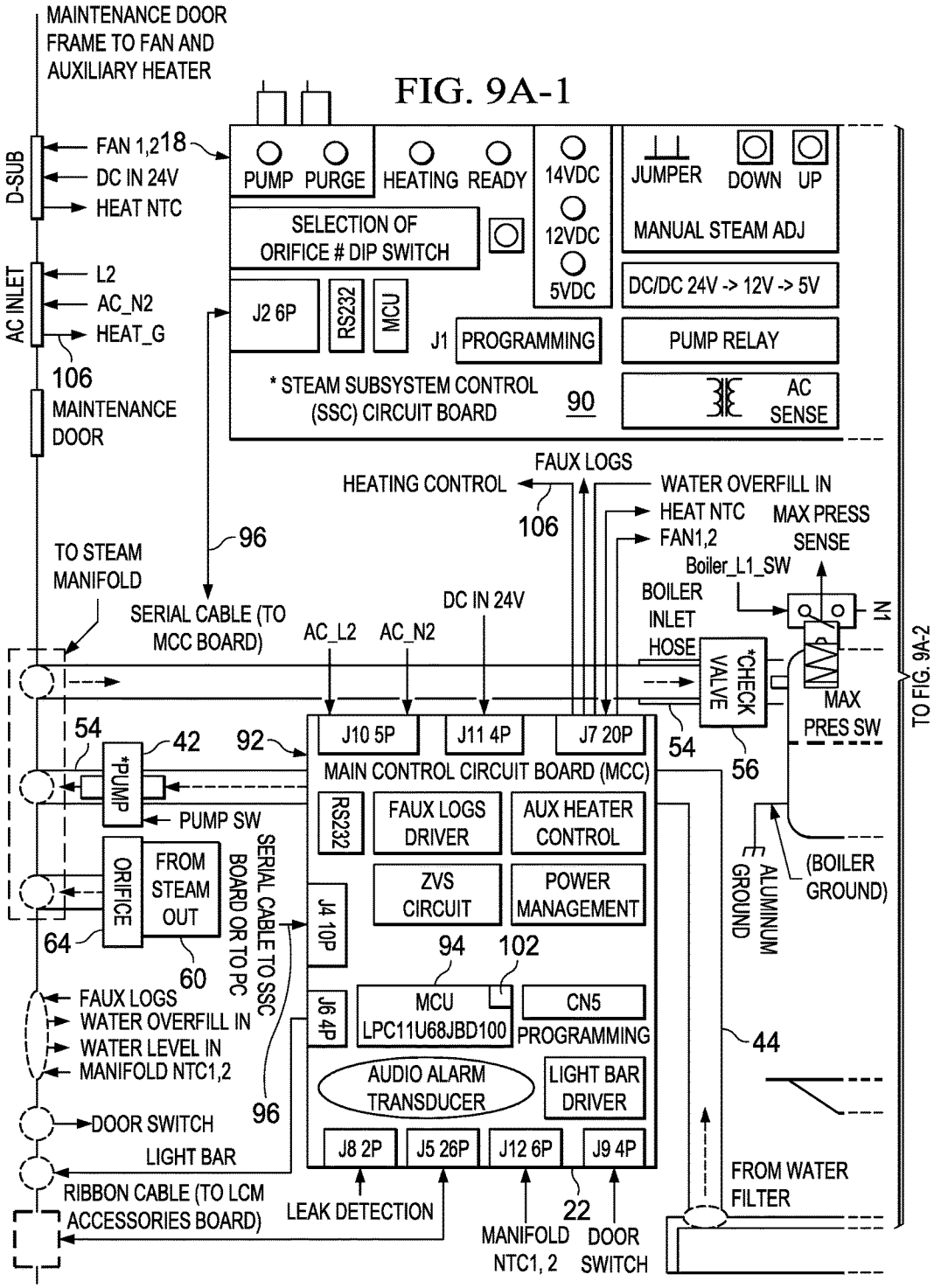
FIG. 9A-1
MAINTENANCE DOOR FRAME TO FAN AND AUXILIARY HEATER
D-SUB
FAN 1,2
18
DC IN 24V
HEAT NTC
AC INLET
L2
AC_N2
HEAT_G
106
MAINTENANCE DOOR
PUMP
PURGE
HEATING
READY
14VDC
12VDC
5VDC
JUMPER
DOWN
UP
MANUAL STEAM ADJ
SELECTION OF ORIFICE # DIP SWITCH
J2 6P
RS232
MCU
J1
PROGRAMMING
DC/DC 24V -> 12V -> 5V
PUMP RELAY
* STEAM SUBSYSTEM CONTROL (SSC) CIRCUIT BOARD
90
AC SENSE
FAUX LOGS
HEATING CONTROL
106
WATER OVERFILL IN
HEAT NTC
FAN1,2
MAX PRESS SENSE
Boiler_L1_SW
96
TO STEAM MANIFOLD
SERIAL CABLE (TO MCC BOARD)
DC IN 24V
AC_L2
AC_N2
BOILER INLET HOSE
*CHECK VALVE
N1
MAX PRES SW
TO FIG. 9A-2
54
42
92
J10 5P
J11 4P
J7 20P
54
56
*PUMP
MAIN CONTROL CIRCUIT BOARD (MCC)
PUMP SW
RS232
FAUX LOGS DRIVER
AUX HEATER CONTROL
ORIFICE
FROM STEAM OUT
SERIAL CABLE TO SSC BOARD OR TO PC
ZVS CIRCUIT
POWER MANAGEMENT
ALUMINUM GROUND
(BOILER GROUND)
64
60
J4 10P
94
102
FAUX LOGS
WATER OVERFILL IN
WATER LEVEL IN
MANIFOLD NTC1,2
J6 4P
MCU LPC11U68JBD100
CN5 PROGRAMMING
44
AUDIO ALARM TRANSDUCER
LIGHT BAR DRIVER
96
DOOR SWITCH
LIGHT BAR
J8 2P
J5 26P
J12 6P
J9 4P
FROM WATER FILTER
RIBBON CABLE (TO LCM ACCESSORIES BOARD)
LEAK DETECTION
22
MANIFOLD NTC1, 2
DOOR SWITCH

STEAM BASED FAUX FIREPLACE

CLAIM OF PRIORITY

This application is a CIP of U.S. patent application Ser. No. 15/687,284 filed Aug. 25, 2017, which claims priority under 35 U.S.C. Section 119 of U.S. Provisional Patent Application U.S. Ser. No. 62/444,073 entitled STEAM BASED FAUX FIREPLACE filed Jan. 9, 2017, the teachings of which are included herein in its entirety.

TECHNICAL FIELD

The present disclosure relates to faux fireplaces that generate realistic faux flames for homes, apartments and other confined locations.

BACKGROUND

Faux fireplaces are commonly used in personal homes, condominiums, apartments and the like to generate a faux (synthetic or simulated) flame when a real wood burning fireplace is not allowable or preferred. Typical faux fireplaces include electric and gas burning fireplaces.

This disclosure includes a faux steam-based fireplace designed to eliminate the challenges and disadvantages commonly associated with gas fireplaces without compromising the realism of the flames. There are two primary disadvantages with gas fireplaces: 1) installation restrictions (must have an available gas line and the particular location is limited subject to venting requirements) and 2) high heat produced by burning gas where heating is not needed or even desired. The steam fireplace of this disclosure delivers a 3-dimensional natural random flame appearance similar to a gas fireplace, but without the installation restrictions and heat issues.

SUMMARY

A steam-based faux fireplace comprising a boiler configured to receive a fluid and generate steam, and a manifold configured to receive the steam from the boiler and emit the steam to generate a steam plume at an output. A very realistic faux flame with a significant length is generated from the low power boiler. The manifold includes a deflector configured to receive directly impinging steam directed thereat from the output, causing the steam to lose some energy and velocity, and turbulently billow about the deflector. The turbulently billowing steam is illuminated to create a realistically looking flame.

BRIEF DESCRIPTION OF THE FIGURES

FIGS. 9A-1, 9A-2, and 9B illustrate the control electronics coupled to the system;

DETAILED DESCRIPTION

The faux fireplace according to this disclosure is a viable alternative to both gas and electric fireplaces with the following marketplace advantages:

Much more realistic faux flames in comparison to electric fireplaces.

Improved Safety—eliminates injury from heat, burns, fumes and gas leaks.

Location Flexibility—can be placed anywhere, as no venting or duct-work is required. The fireplace doesn't require an access route to a roof or outside wall as a gas fireplace does.

TV Safe—One of the most popular fireplace installations is below a flat screen TV. However, gas fireplaces produce heat that shortens the life of the TV. The faux fireplace of this disclosure produces no such damaging heat.

Eco-friendly—Steam-based technology uses electricity and water instead of directly burning natural gas or propane, so it is perceived as better for the environment having no direct carbon emissions that gas fireplaces have.

Lower Upfront Cost—50%-70% of the cost of a comparable gas fireplaces.

Lower Ongoing Operational Cost—it costs less to use on a daily basis that burning gas or propane.

Figure 1:
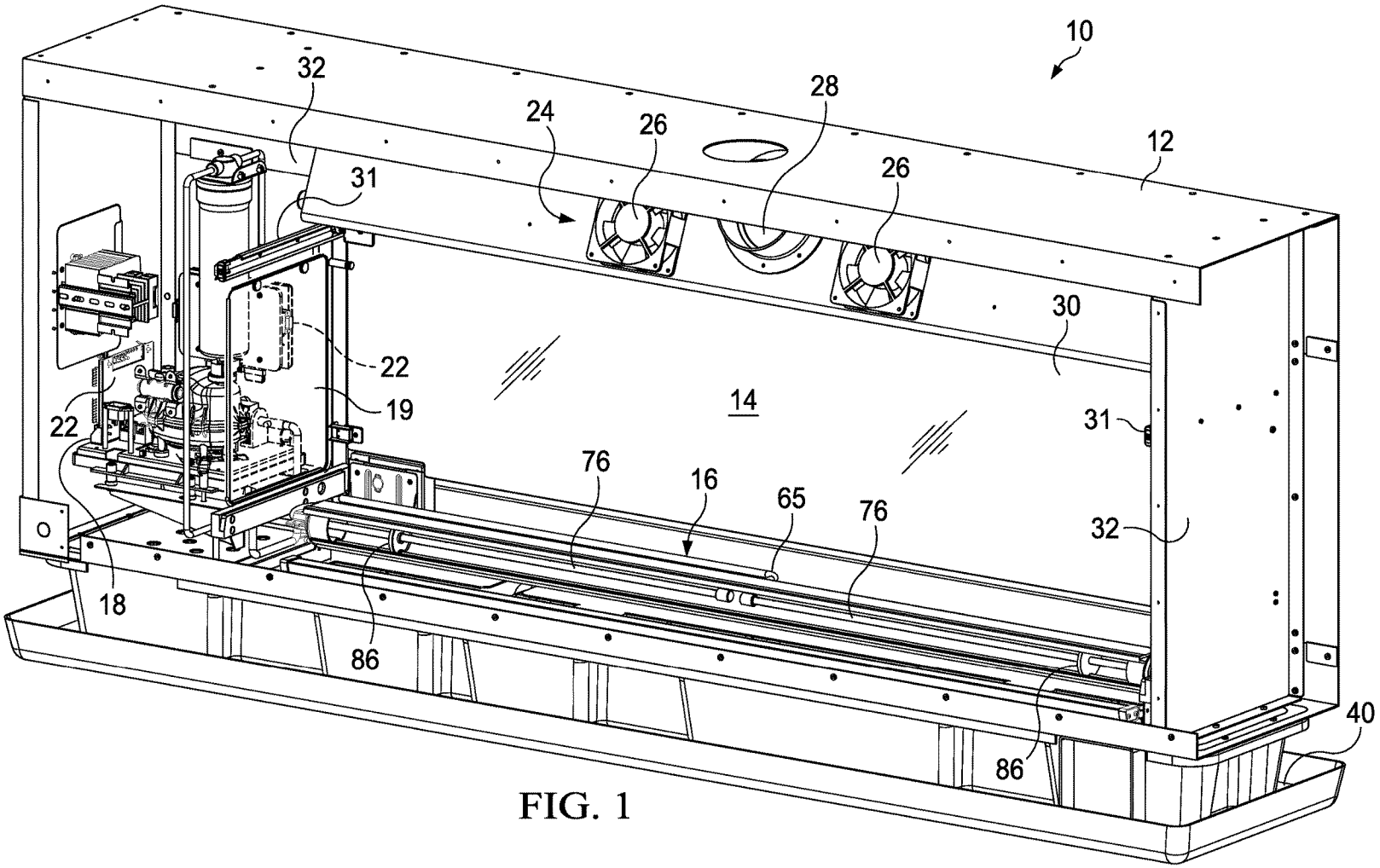
FIG. 1 illustrates a perspective front view of the faux fireplace.
Figure 2A:
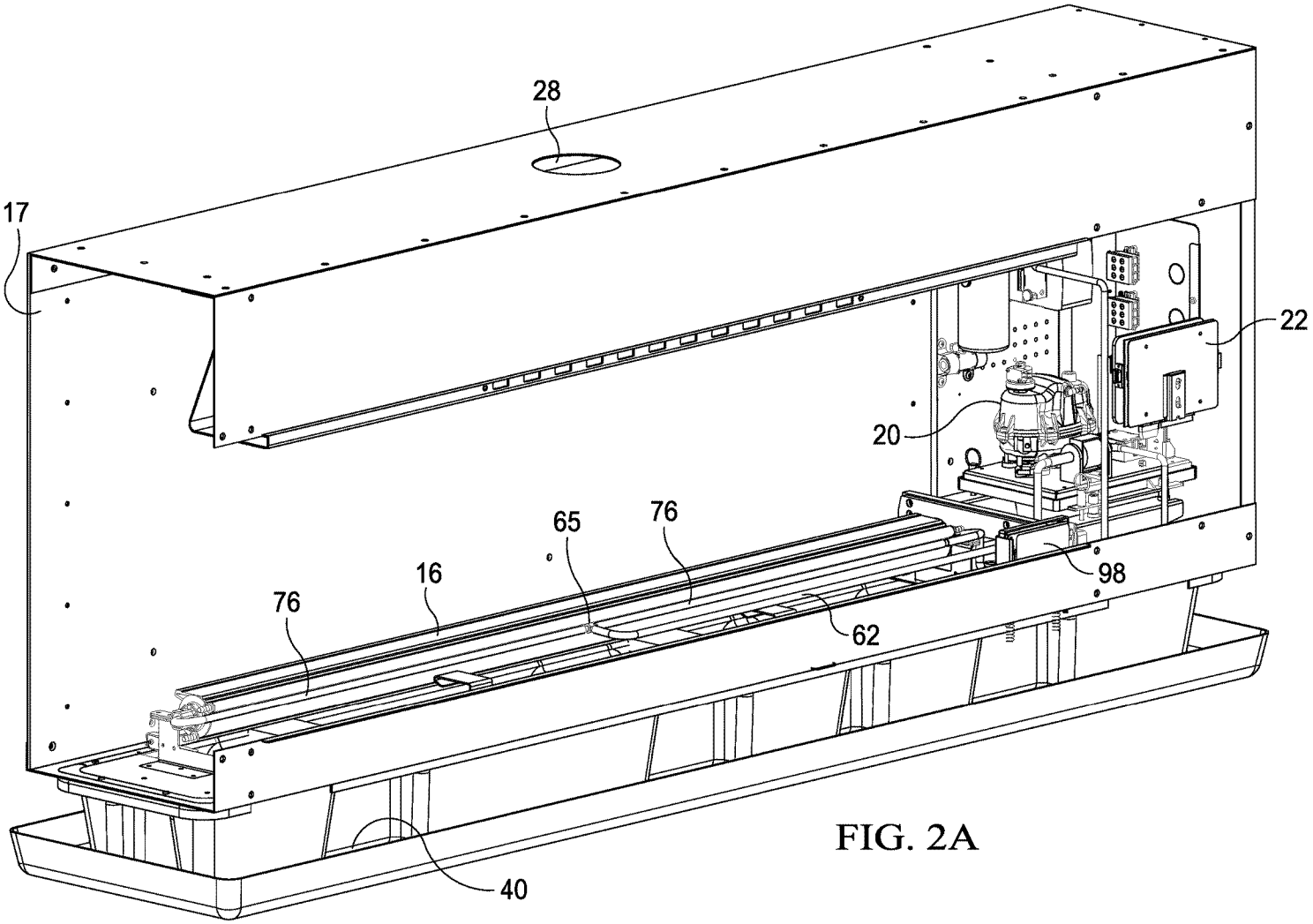
FIGS. 2A and 2B illustrate a side perspective view of the faux fireplace of FIG. 1 with the end wall and glass face removed.
Figures 2, 9A:
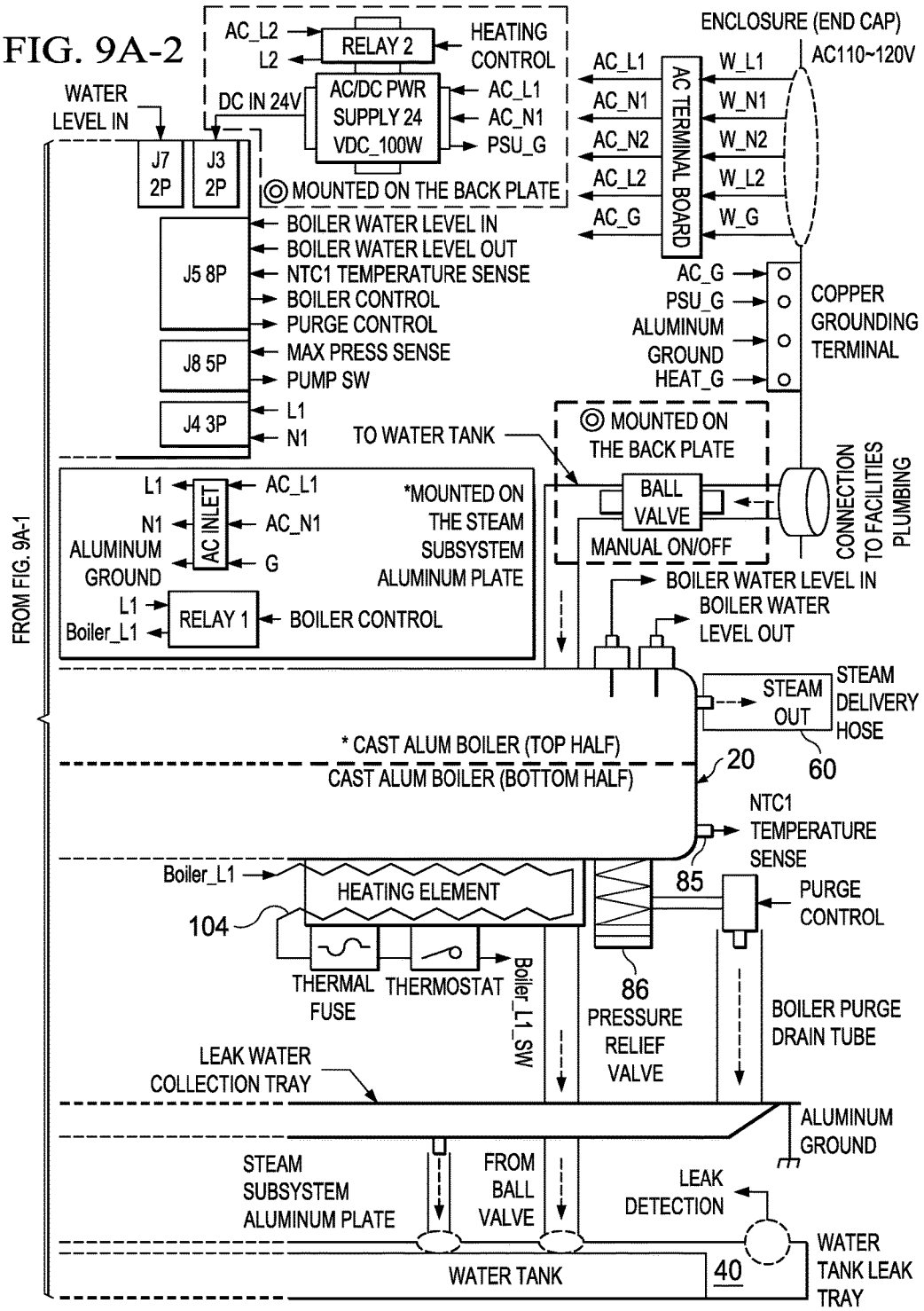
Figure 9B:
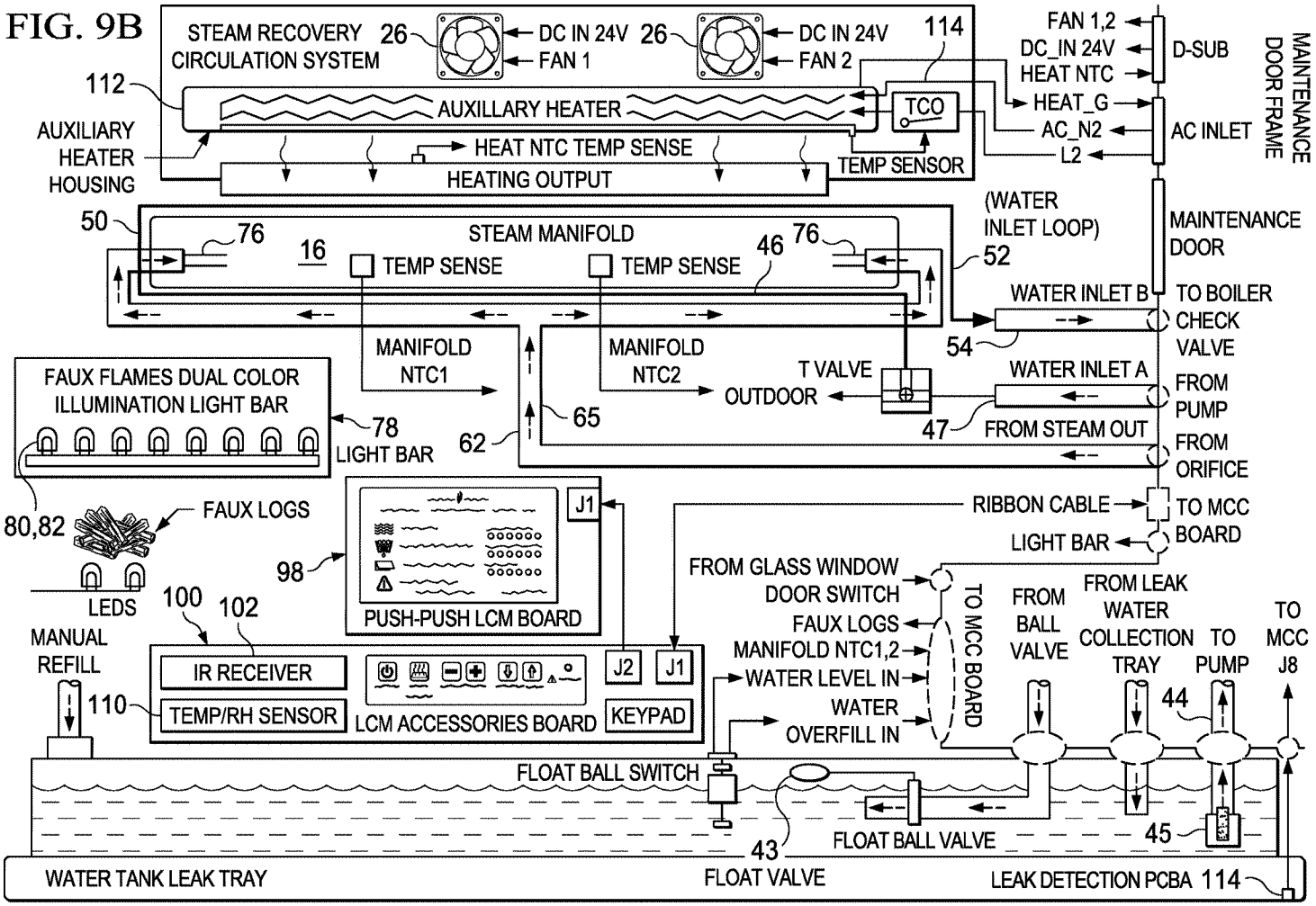

FIG. 1, and FIG. 2A depict the steam based self-contained faux fireplace at 10. Fireplace 10 is seen to have a generally elongated and rectangular housing 12 including a cavity 14 including a manifold 16 configured to generate a steam based illuminated faux flame. The manifold 16 is situated in the bottom of the cavity 14, and is fed steam by a boiler unit 18 disposed in one end of the fireplace 10 as shown. The boiler unit 18 has a low power boiler 20 controlled by control electronics 22. Control electronics 22 includes a circuit board in boiler unit 18, and a main circuit board as shown (see FIGS. 9A-1 and 9A-2). The boiler 20 is a small pressure vessel configured to efficiently produce steam under computer controlled settings, and has reduced power requirements and water consumption. Details of the steam generation system and control electronics are shown in FIGS. 9A-1 and 9A-2, and will be described in additional detail shortly.

The fireplace 10 has a vent assembly 24 at the top of the cavity 14 and configured to selectively vent moisture from within the cavity 14. The vent assembly has a pair of fans 26 configured to draw moisture from above the manifold 16 and an outlet 28 thereover configured to vent the drawn moisture to the ambient. The fireplace 10 has a retractable glass panel 30 extending across a front side opening of housing 12, and which glass panel 30 can be retracted upward and into the cavity 14 like a garage door upon railings 31 formed in opposing sidewalls 32 to allow access to the manifold 16 and the control electronics 22. A rear panel 17 of housing 12 can comprise a solid panel comprised of metal or the like, and may include another glass panel if it is desired to have a see-through fireplace 10. A removable interior panel 19 allows access to the boiler unit 18 and boiler 20, control electronics 22, conduits, a water filter, water pump, and other features from within cavity 14.

Figure 3:
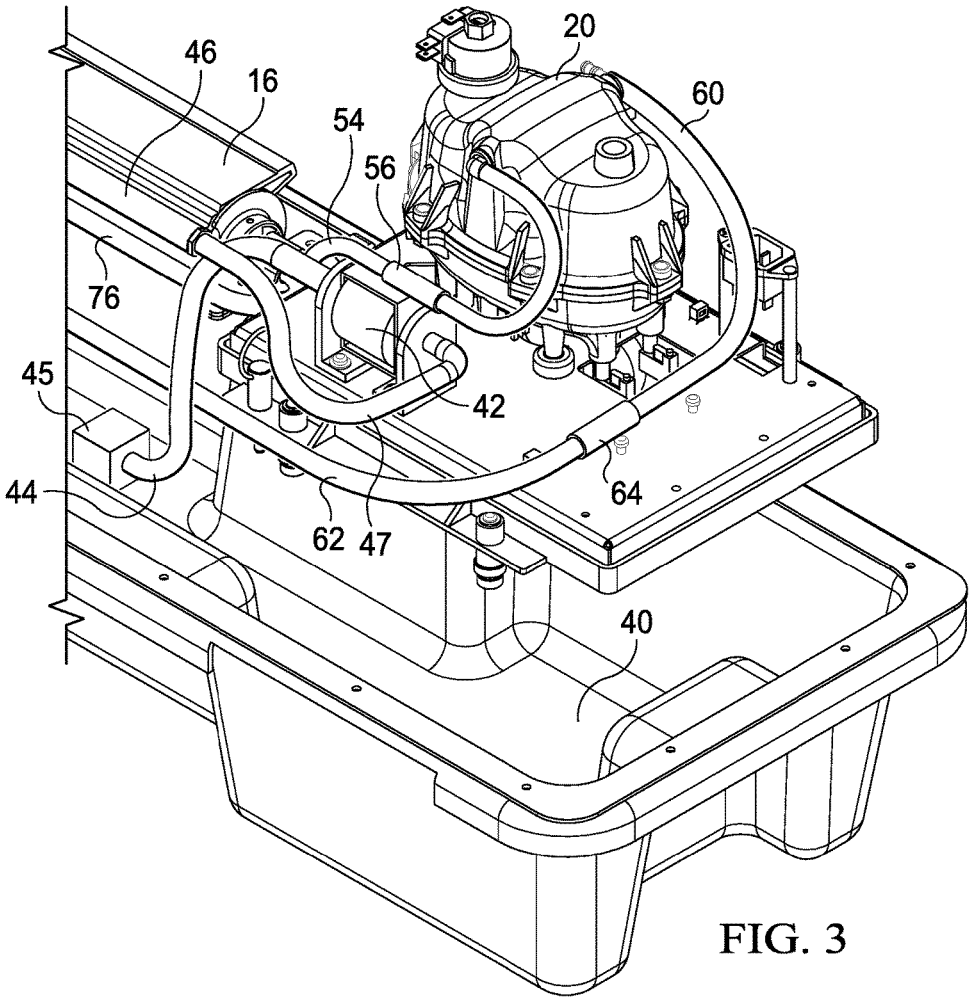
FIG. 3 illustrates a partial view of the boiler, reservoir and conduits extending to and from the manifold.

Referring to FIG. 3, the fireplace 10 has a water reservoir 40 formed in the bottom of the housing 12 under the manifold 16 configured to hold water. A water pump 42 is configured to controllably draw water from the reservoir 40 via a flexible conduit 44 comprising tubing. A water level sensor 43 is positioned in reservoir 40 and provides water level information to control electronics 22 (FIGS. 9A-1 and 9A-2, 9B). A replaceable water filter 45 may be in line with conduit 44 to filter particulates from the water, as shown in FIGS. 9A-1 and 9A-2 and FIG. 9B.

Figure 5:
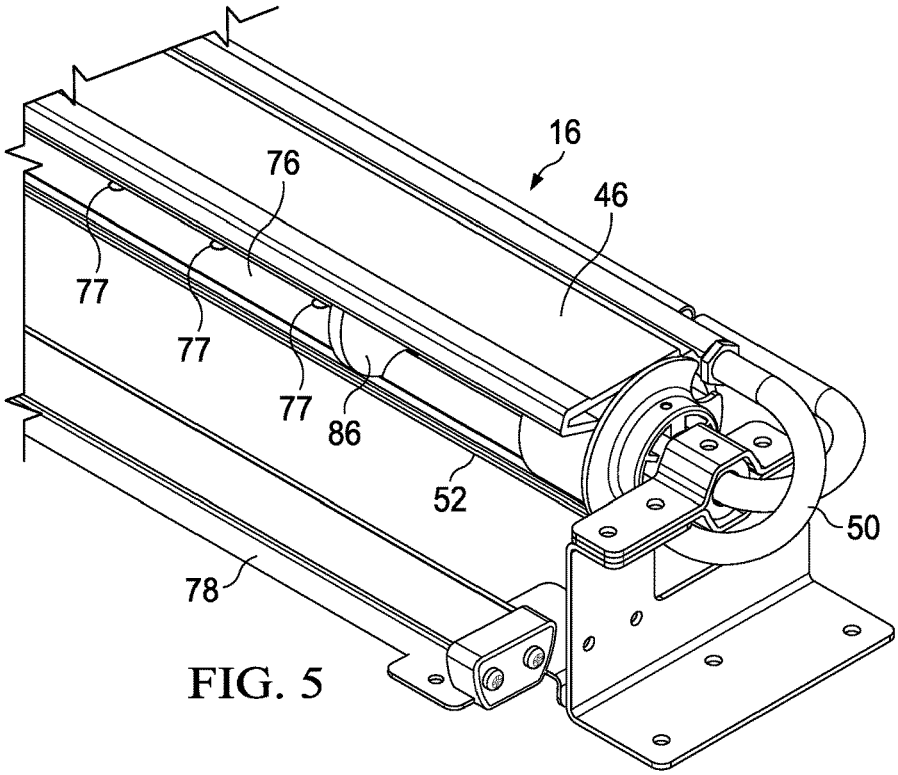
FIG. 5 illustrates an end view of the manifold and light bar.

Advantageously, a conduit 47 routes the drawn water from pump 42 to a first conduit 46 that is integrally and rigidly formed in the elongated manifold 16 along the length of the manifold on a near side. This causes the water in the conduit 46 to heat up by the heated steam emitted by the manifold 16, as will be discussed shortly. As shown in FIG. 5, a flexible conduit 50 receives the partially heated water at the far end of conduit 46, and routes the partially heated water back to a second conduit 52 that is also integrally formed in the elongated manifold 16 and extending along a back and lower side of the manifold 16. This causes the water to be further heated by the steam emitted by the manifold 16. As shown in FIG. 3, a flexible conduit 54 receives the heated water, and routes the heated water via a check valve 56 to the boiler 20. The check valve 56 is configured to prevent water returning to the reservoir and maintain steam pressure in the boiler 20. The unique routing of the water from the pump 42 along both sides of the manifold forms a pre-heater that heats the water before the water is boiled in the boiler 20. This configuration reclaims steam energy from the emission used for the faux flame effect. The reclaimed heat increases efficiency, allowing a smaller, efficient boiler 20 to be used as less energy is required to heat the pre-heated water to a boiling temperature of 100-130 degrees C., depending on the boiler pressure setting. The boiler can be operated on standard 120 VAC, 20 amps as opposed to 240 VAC drawing larger current, and which is not readily available in homes, apartments and the like. The total power load of fireplace 10 at any given point in time does not exceed 1920 Watts at 120 VAC, or 1760 Watts at 110 VAC. The heated water is provided to the inlet of boiler 20 at a consistent temperature, thus minimizing temperature shock when water is added to the boiler 20. Without this feature, cold water provided to the boiler 20 shocks the boiler 20, knocking down the flame effect provided by manifold 16. Advantageously, this pre-heating provides a more consistent flame effect despite variations in water supply temperature.

Figure 4:
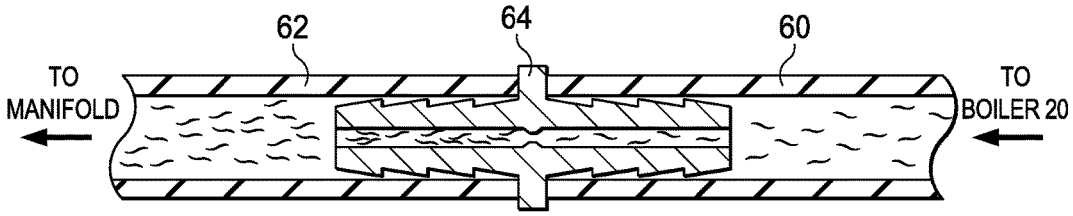
FIG. 4 illustrates an orifice.

The boiler 20 is configured to route the boiled water to a manifold feeder conduit 60 via a flexible conduit 62 and an in-line pressure controller 64, preferably comprised of a valve having a variable controlled orifice. As shown in FIG. 4, the variable orifice 64 is configured to controllably regulate and maintain a volume and pressure of steam directed against a deflector 70, causing the regulated steam delivered by the orifice 64 to be released at a higher velocity downstream compared to the velocity and pressure generated by the boiler 20. Orifice 64 is controllably set by a controller to have a larger opening when fireplace 10 is operating in higher ambient temperatures to generate a pressure and velocity at a first setting. The controller is set by the controller to have a smaller opening in a second setting when fireplace 10 is operating in colder ambient temperatures to generate a superior faux flame effect across varying temperatures. This is needed to allow precise control of the stream properties and appearance over the full operating temperature range. In one embodiment, the orifice 64 can comprise a variable opening orifice digitally controllable by control electronics 22.

Advantageously, the manifold feeder conduit 60 and conduit 62 are angled slightly downward from the boiler 20 to a t-shaped connector 65 feeding a pair of steam distribution conduits 76. The angled conduit 62 directs any liquid in the conduit 62 downwardly such that liquid does not puddle in the conduits 60 and 62. Otherwise, liquid in these conduits could make undesirable sounds, such as a sound imitating a sparking sound.

Figure 6:
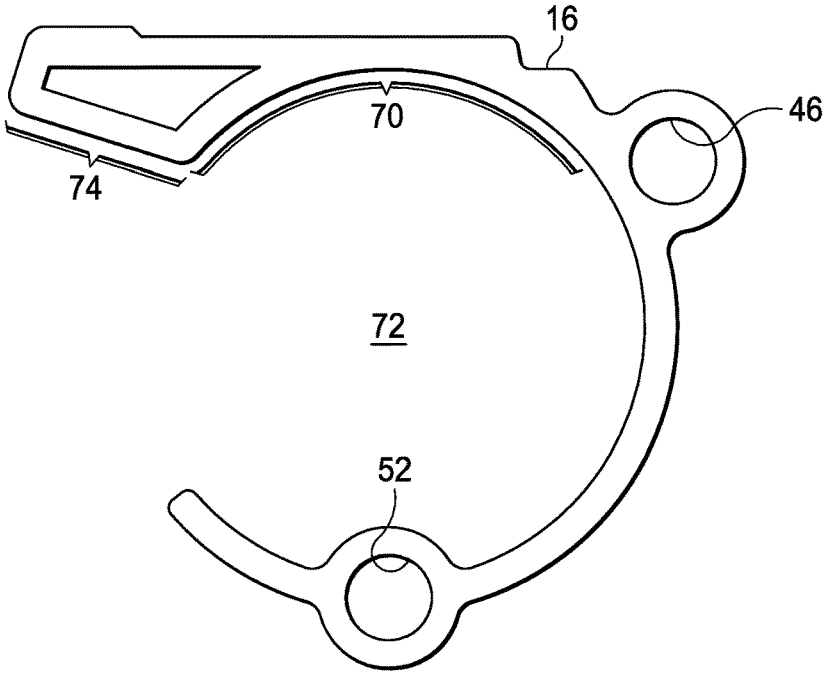
FIG. 6 illustrates the steam deflector and lip.
Figure 7:
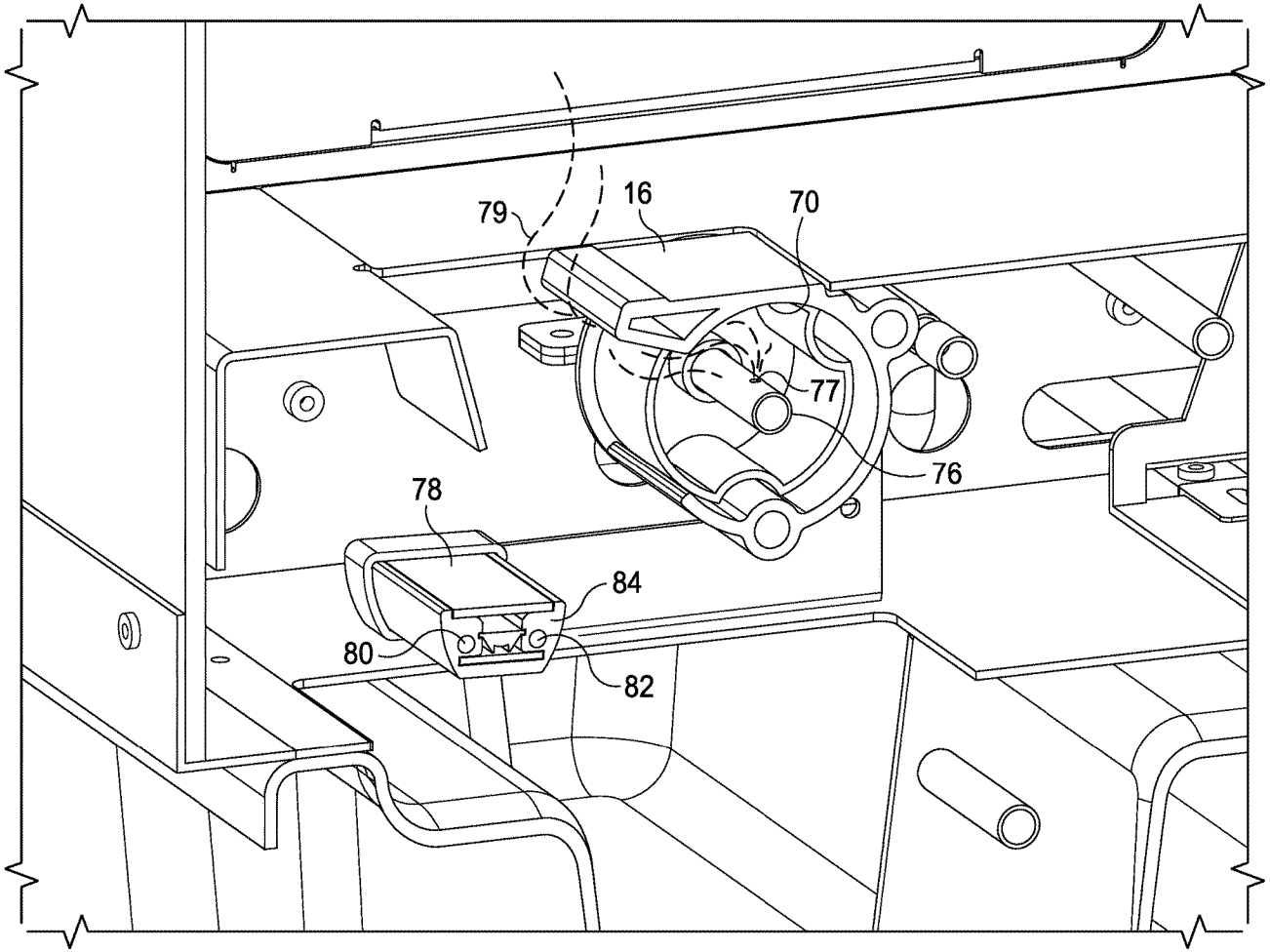
FIG. 7 illustrates steam directly impinging upon the steam deflector causing deflected steam to turbulently billow below and around the lip.

Referring now to FIGS. 5, 6 and 7, a detailed description of the manifold 16 will be provided. A vertical cross section of manifold 16 is shown in FIG. 6, illustrating the manifold 16 having an upper curved interior surface forming a deflector 70 over a manifold cavity 72, and extending to a lip 74. As shown in FIG. 1, FIG. 2A and FIG. 7, the pair of steam distribution conduits 76 are configured to loop around the manifold 16 and then extend down the middle of cavity 72, each conduit 76 terminating proximate the other in the middle of manifold 16.

Advantageously, each of conduits 76 have a plurality of spaced openings 77 configured to both release and direct a stream of steam upwardly in a first direction to directly impinge against the curved interior surface of deflector 70 opposite the openings 77. The openings 77 direct a released stream of steam directly against the opposing curved inter surface of deflector 70 such that at least a portion of the stream of steam is normal (perpendicular) to the opposing curved inter surface of deflector 70. This configuration of openings 77 and opposing deflector 70 advantageously causes the directly impinging stream of steam to deflect in a second direction different than the first direction and lose some energy and velocity, and the deflected steam turbulently billows outwardly, around lip 74, upwardly. The stream of steam loses all forward velocity in the first direction from the openings 77, and thus all directed steam is deflected and turbulently billows about the deflector lip 74. This turbulently billowing steam is then illuminated by a light source 78 to create a very realistic faux flame 79 in 3 dimensions. The deflector 70 is concave and encompasses the manifold output at least 180 degrees. The arcuate concave surface is configured such that a majority or all portions of the stream of steam impinge the concave surface normal to the concave surface. The openings 77 may extend along an imaginary longitudinal central axis with respect to the arcuate surface. The arcuate surface may be circular to form the imaginary axis such that all portions of the steam of steam impinge the normal to the arcuate surface, to maximize the turbulent billowing of the steam.

The light source may be a high intensity white LED light strip with LEDs positioned under a curved lens 84 and arranged to shine through color gel filters, or alternately, may be a multi-colored LED light strip having longitudinally extending orange LED lights 80 and red LED lights 82 positioned under the curved lens 84. A plurality of disc-like separators 86 are disposed about conduit 76 along the length of conduit 76, and are spaced to form adjacent pockets within manifold 16 to create a generally uniform release of steam along the length of the manifold 16. Any moisture that returns to the liquid state drips back into reservoir 40, to create a self-draining steam delivery network. As previously discussed, the billowing steam emitted by the manifold 16 preheats the water circulating though integral conduits 46 and 52, thereby using reclaimed steam energy from steam emission used for the faux flame effect. The reclaimed heat increases efficiency, thus enabling a lower power solution operable from 120 VAC instead of 240 VAC.

The light source 78 requires approximately 30 Watts. Fire bed media may be provided over manifold 16, and may include fire bed illumination. The fire bed illumination may include user adjustable RGB LED lighting for special effects illumination of the fire bed media. The fire bed lighting functions regardless of whether the fireplace 10 is on or off, to allow use as mood/ambience lighting. Fire bed media shall be lit completely and evenly in front and along both sides of the faux flame. No lighting is provided for the media bed area behind the faux flame 79. The LED light 78 running the length of the front and sides of the faux flame 79 provides the necessary illumination. Faux logs may be placed on top of the fire bed media, and/or over the manifold 16. Faux log lighting may be provided operating at approximately 5 Watts. Firmware controls automatically vary the intensity of the faux log lighting per a control algorithm to generate a realistic "glowing" effect when the faux flame 79 is active.

The control electronics 22 determines the steam pressure in boiler 20 by first sensing the temperature of the boiler 20 housing using temperature sensor 85. The control electronics 22 includes memory storing a table correlating the sensed boiler housing temperature to a calculated steam pressure in the boiler 20. Using the Ideal Gas Law, PV=nRT, the boiler steam pressure P is directly proportional to the steam/boiler housing temperature T. The table associates a measured housing temperature T to calculated steam pressure P.

Boiler unit 18 has a boiler auto-fill mechanism. The control electronics 22 on the steam subsystem circuit board 90 (FIG. 9A) utilizes a water level sensor to inject varying quantities of water into the boiler 20, via commands to the pump 42, minimizing the shock to the boiler 20 and thus maintaining a consistent faux flame 79 effect. Volume and timing of water injection into boiler 20 is determined based on calculated steam emission rate and the timing of the power applied to the boiler 20.

Figure 8:
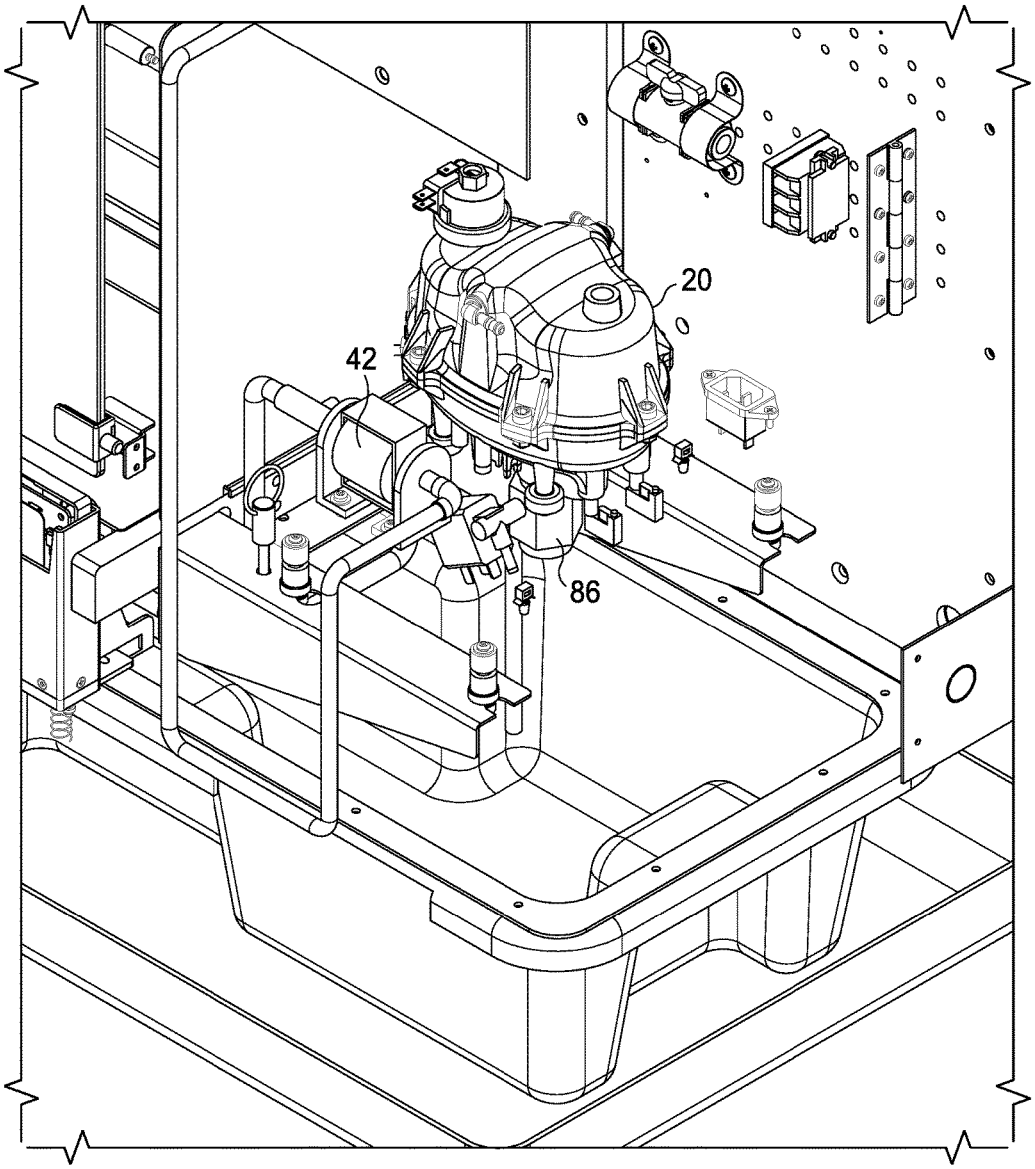
FIG. 8 illustrates the boiler.

Referring to FIG. 8, a purge valve 86 is coupled to a bottom of the boiler 20, and is configured to purge water and steam from the boiler 20 upon receipt of a purge signal received from control electronics 22. The purge valve 86 may be a solenoid driven valve, although other types of controllable valves are acceptable. Advantageously, the purge valve 86 remove any particulates, such as sediment, that may build up on the bottom of the boiler 20 due to the violent release of water and steam and the reduction of pressure. This advantageously extends the mean time between failure (MTBF) of the boiler 20. The purge valve 86 also helps shut down the boiler quickly when controlled by the control electronics 22, and complete a shut down cycle.

Referring now to FIGS. 9A-1 and 9A-2, and 9B, control electronics 22 is seen to comprise a steam subsystem circuit board 90 controlling the boiler unit 18 including boiler 20, and a main controller board 92 including a microcontroller 94 that controls fireplace 10, including the circuit board 90 via communications interface 96. The control electronics 22 controls various functions of the fireplace 10, and has a hardwired user interface 98 including a keypad and a display coupled to the control electronics 22 allowing a user to select functions and control the fireplace 10. A wireless remote control 100 (FIG. 2B and FIG. 9B) is configured to communicate with the microcontroller 94 via an infrared (IR) transceivers 102. The microcontroller 94 monitors fireplace 10 in real-time. The main controller (MC) circuit board 92 implements the user interface 98, supervisory functions, and wireless connectivity functions for the fireplace. The total power available to MC circuit board 92 is approximately 5 Watts, and includes sufficient non-volatile memory to allow saving of user settings. The MC circuit board 92 includes a real-time clock (RTC) function that allows tracking of accumulated runtime hours and water filter replacement scheduling.

Microcontroller 94 controls the height of the faux flame 79 via circuit board 90 by sensing the housing temperature T of boiler 20 using thermostat 85 and controlling the power delivered to heater coils 104 formed in the bottom of the boiler 20 via conductors 106. The power is regulated by microcontroller 94 to vary pressure in the boiler 20, and thus the height of the faux flame 79. A preferred method is based on zero cross switching. More power creates higher boiler pressure and a higher faux flame 79, and less power creates a lower boiler pressure and a lower faux flame 79. Typical boiler operating pressures range between about 8-30 psi, and typically no greater than 25 psi. The user uses the user interface 98 or remote control 100 to command the microcontroller 94 to vary faux flame 79 height. The fans 26 create some upwardly directed air flow to help keep moisture from accumulating on the glass panel 30, even at the highest faux flame 79 level.

Microcontroller 94 provides autosensing for automatic control and adjustment of the faux flame 79. Microcontroller 94 senses major variables that affect the quality of the faux flame 79, including ambient temperature via temperature probe 110, ambient humidity, and manifold temperature. The real-time microcontroller 94 provides for automatic adjustment of the pressurized boiler unit 18 for the faux fire effect, thus enabling a consistent faux flame 79 for varying conditions. The microcontroller 94 also controls the orifice 64 to adjustably and selectively set the size of the orifice and thus the height of the faux flame 79 as discussed earlier.

Fireplace 10 includes an auxiliary heater 112 configured to generate heat and augment the heat produced by the steam emitted from manifold 16. Power to the heater 112 is provided via conductors 114 and is controlled by microcontroller 94, which is also controllable by the user via the user interface 98 and/or remote control 100. The auxiliary heater 112 uses a dedicated 20 Amp branch circuit separate from the rest of the fireplace 10 power, and the heater does not draw more than 16 Amps.

The optional auxiliary heater assembly includes its own dedicated thermal safety cutoff switch located adjacent to the heater assembly. The thermal safety switch senses if the enclosure exceeds 162 degrees F. (72 C). A thermal safety switch interrupts power to the auxiliary heater. The thermal switch is resettable type and serviceable.

The fireplace has a water leak sensor 114. Sensor 114 is mounted in the bottom reservoir such that the unexpected presence of water triggers an audio alarm. The MC circuit board 92 enters Service Mode, displaying the "Contact Service" screen and the fault code associated with a leak.

Figure 10A:
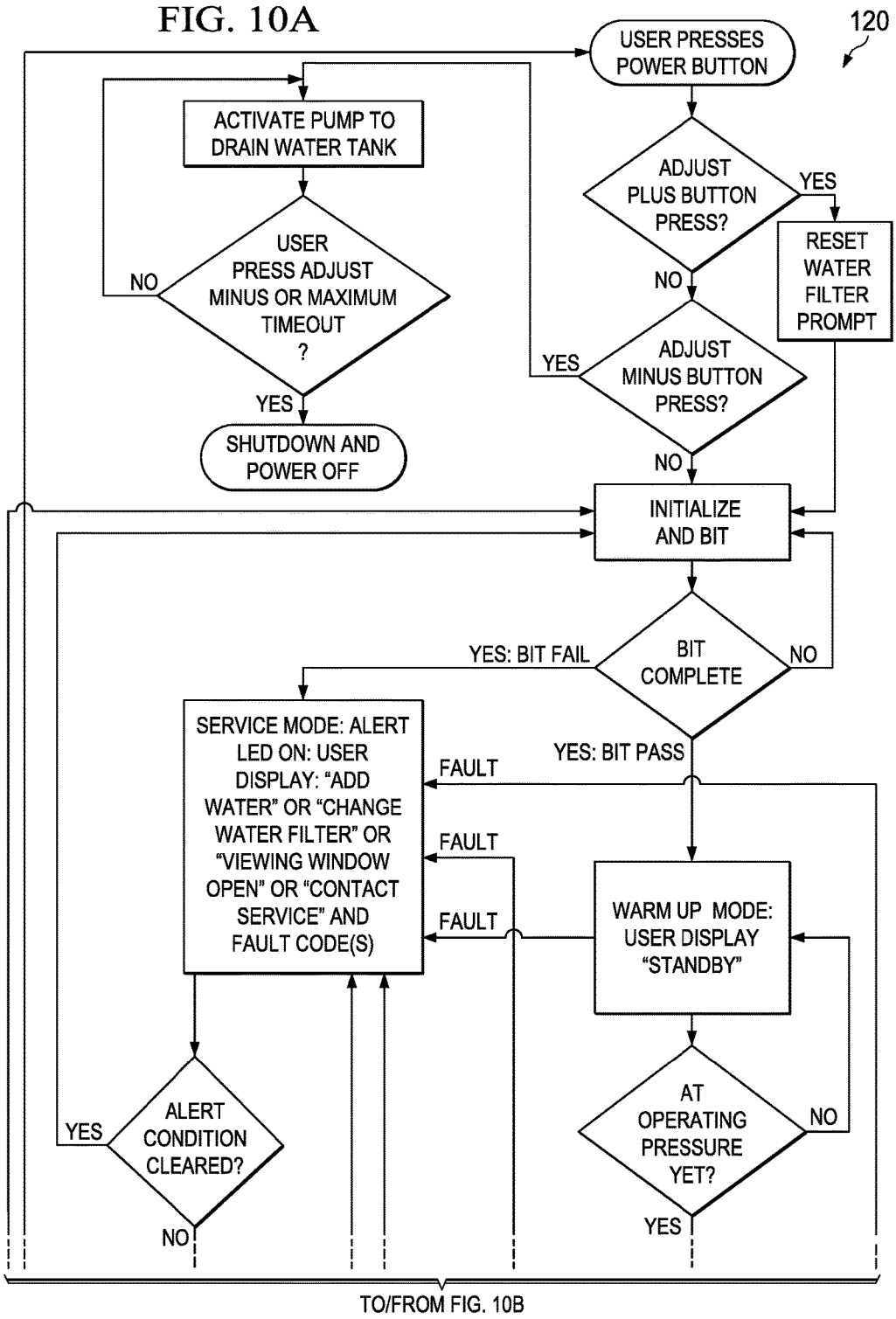
FIGS. 10A and 10B illustrates an operational flow chart of the algorithm operating the faux fireplace.
Figure 10B:
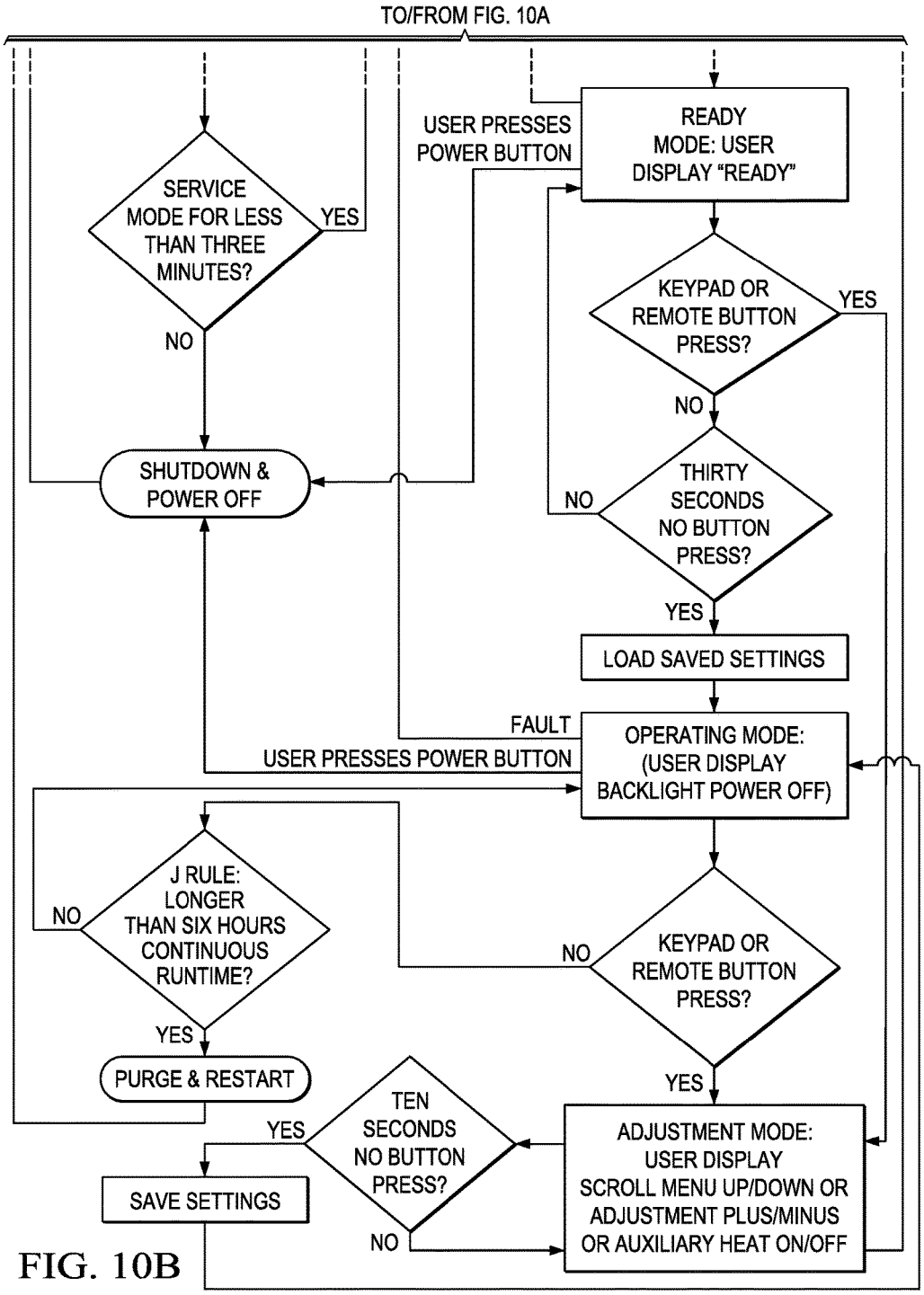

Referring to FIGS. 10A and 10B, the control electronics 22 including microcontroller 94 control and operate the fireplace 10 using the operational flowchart (algorithm) 120 shown. Warm-up time of fireplace 20 from a standby mode to a ready mode is 1-3 minutes depending on the power up conditions.

User Interface

The fireplace 10 provides as standard, a user display, a manual keypad interface and a wireless remote control interface 100.

Figure 2B:
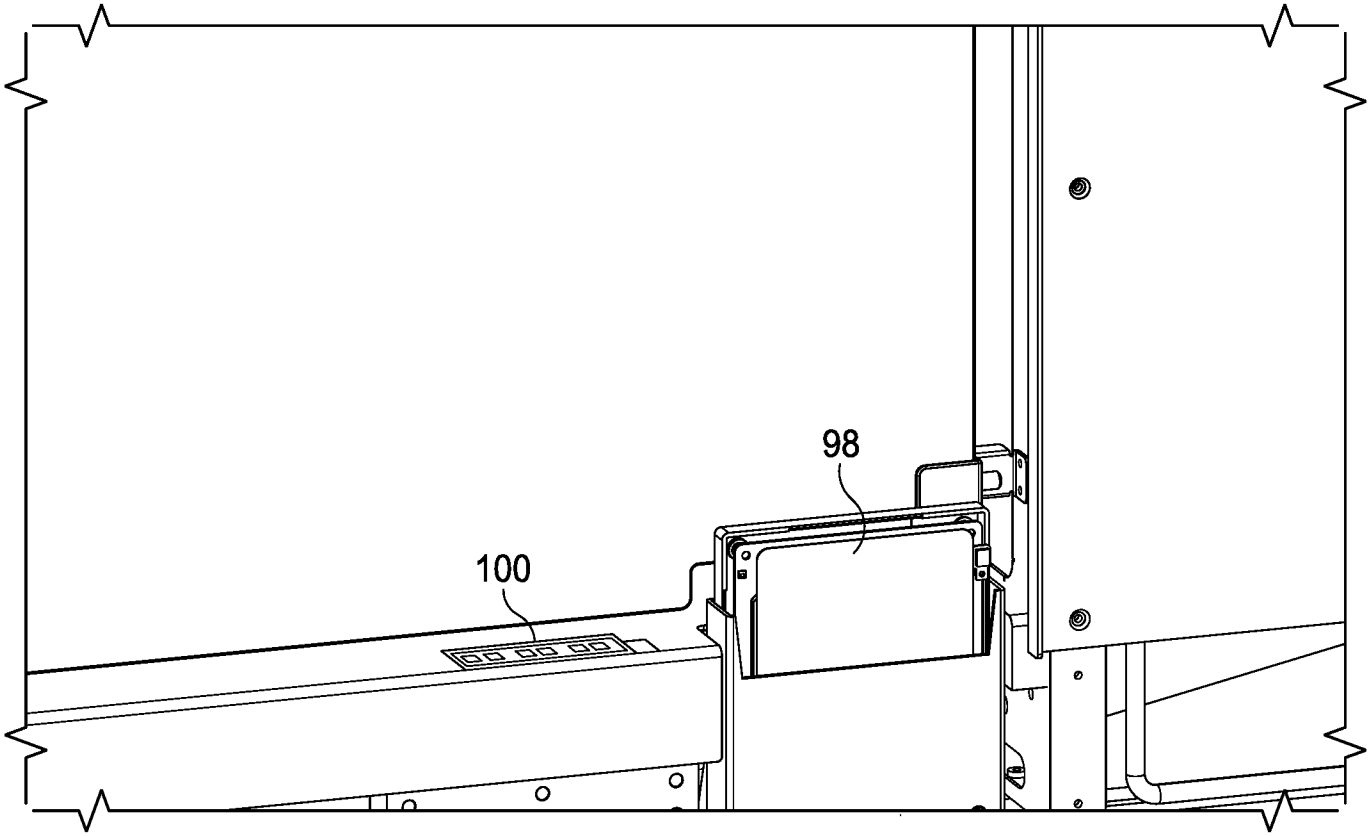

User Display: An industry standard form factor custom 4.3" LCD display 98 is mounted in a recessed location in the lower right hand corner in front of the glass firebox viewing window (FIG. 2B).

Figure 11:
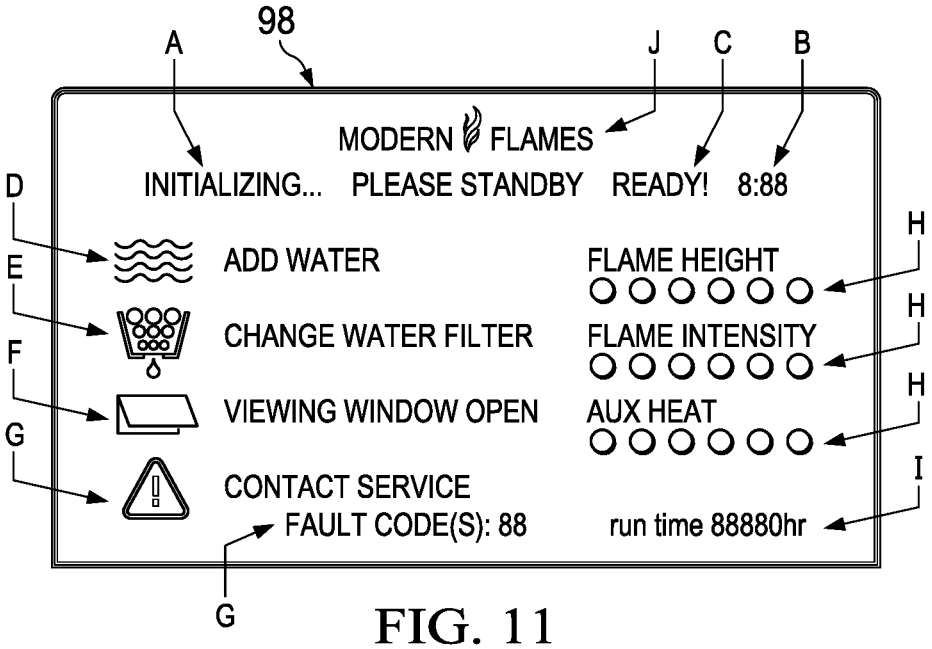
FIG. 11 illustrates the user interface.

User Display Features: The user display 98 functions per the operational flowchart 120 (FIG. 11) with features as follows:

- The user display 98 is mounted in a mechanical "carriage mechanism" (FIG. 2B) that allows the user to:
  - Push down to release and allow viewing of the entire display.
  - Push down to latch and hide the display from view (the normal operation position).
- While the system is in Warm Up mode, the initializing icon indicates progress and the text "Initializing . . . Please Standby" is displayed ("A" in FIG. 11). A countdown timer displays time remaining ("B" in FIG. 11).
- When the system is at operating pressure and the timer expires (displays all zeros), the initializing icon and the text "Initializing . . . Please Standby" are no longer displayed and the text "Ready" is displayed.
- When there is an "Alert" Condition and the system is in Service Mode (refer to the Operation Flow Chart), the Alert LED on the keypad flashes ("C" in FIG. 11). The user then knows to push down to release and allow viewing to the entire display.
- When the water tank is low, the water icon and the text prompt "Add Water" is displayed ("D" in FIG. 11).
- When the amount of accumulated hours reaches a threshold, the filter icon displays along with the text prompt "Change Water Filter" ("E" in FIG. 11).
- If the viewing Window glass door is open, the fireplace will not operate and the window icon and the text "Viewing Window Open" is displayed ("F" in FIG. 11).
- When the built-in test detects a fault, the Service Icon and the text prompt "Contact Service" is displayed, along with the fault code(s) ("G" in FIG. 11). If there is more than one fault, the display slowly cycles through all the applicable codes.
- When the User adjust the flame height, intensity, or auxiliary heat up or down, the relevant text displays and the associated select indicator advances ("HI" in FIG. 11).
- A run timer ("F" in FIG. 1) displays the total number of hours that the steam subsystem has been operating since installation. This information is used primarily for tracking purposes and interaction with technical support.
- The Display includes the Modern Flames logo ("J" in FIG. 11). The logo is displayed continuously when the Display is powered up.

Figure 12:
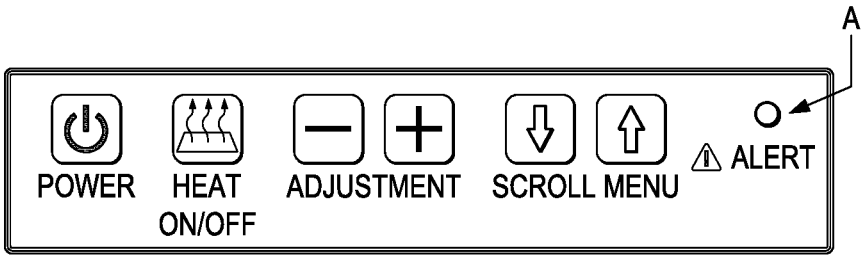
FIG. 12 illustrates the remote control buttons and LEDs.

Keypad: A tact switch user interface keypad, with the arrangement as shown in FIG. 12, is located at the bottom right of the Viewing Window frame.

Remote Control: A simple custom Infrared-type remote 100 is provided. The remote control 100 implements the same functionality as the keypad and provides for wireless same room direct line-of-sight fireplace operation.

- Steam Fireplace Feature Set
- Unprecedented realism in a simulated flame
  - 3-dimensional natural random flame
- High quality/high-end construction
  - Utilizes superior materials and finishes that are configurable to complement any room dëcor.
- Economical:
  - Lower cost to purchase, lower cost to install, lower cost of use in comparison to gas fireplaces.
- Dependable & Serviceable:
  - Comparable to gas fireplaces
  - Steam generation subassembly is removable/replaceable
  - Expected service life of 20 years
- Easy-to-Use Controls
  - LCD User display: Displays settings, status, and user guidance.
  - Keypad: Allows operation without a remote control.
  - Remote Control: Wireless "TV" type of remote (Infrared technology).
  - Mobile Phone App "Ready"
    - Electronics design supports connectivity via wireless control network (ZigBee protocol).
    - Allows control via a mobile smart phone app
  - Controllable Features:
    - Fireplace On/Off
    - Flame Height: User may adjust the flame height (6"-12")
    - Flame intensity: User may adjust flame effect light source from low to high.
    - Auxiliary Heat On/Off and Temperature Increase/Decrease
- Ease of installation
  - Zero clearance for built-in appearance: Allows for framing and finishing of wall material right up to the opening of the fireplace (no surrounding bezel)
    - Allows for finishing with different thicknesses of building materials, such as drywall, stone, tile, etc.
  - Utilizes a standard dedicated 110-120 VAC @ 60 Hz 20 A circuit.
  - Built-in Water Reservoir: Allows for 10 hours of continuous use without re-filling. May be manually refilled for installations where no plumbed water source is present.
  - Optional plumbed water source: utilizes a standard "ice-maker" type of connection.
  - Integrated water filter system:
    - Ensures clean operation and full rated product life.
    - User Display prompt when replacement is needed
- Available in two standard sizes (42", 60")
- Heats and humidifies the room:
  - Produces pleasant room warming heat and desirable humidity as a byproduct of steam production.
  - Auxiliary heater unit provides additional warmth for cold climate installations.
- Firebox Liner: the inside of the firebox is designed to accept various decorator liners.
- Faux log set
  - LED lighting provides realistic lit logs and glowing embers effect The appended claims set forth novel and inventive aspects of the subject matter described above, but the claims may also encompass additional subject matter not specifically recited in detail. For example, certain features, elements, or aspects may be omitted from the claims if not necessary to distinguish the novel and inventive features from what is already known to a person having ordinary skill in the art. Features, elements, and aspects described herein may also be combined or replaced by alternative features serving the same, equivalent, or similar purpose without departing from the scope of the invention defined by the appended claims.

The invention claimed is:

1. A steam-based faux fireplace, comprising:

a boiler configured to receive a fluid and generate steam;

a manifold configured to receive the steam from the boiler and emit the steam at an output, the output comprising an opening configured to direct the steam to create a stream of steam in a first direction; and a deflector opposed from the opening such that the directed stream of steam from the opening is configured to impinge against the deflector, the deflector configured to reduce energy and velocity of the stream of steam and deflect the stream of steam to turbulently billow about the deflector, wherein at least a portion of the stream of steam is configured to impinge the deflector normal to the deflector.

2. A steam-based faux fireplace, comprising:

a boiler configured to receive a fluid and generate steam;

a manifold configured to receive the steam from the boiler and emit the steam at an output, the output comprising an opening configured to direct the steam to create a stream of steam in a first direction; and a deflector opposed from the opening such that the directed stream of steam from the opening is configured to impinge against the deflector, the deflector configured to reduce energy and velocity of the stream of steam and deflect the stream of steam to turbulently billow about the deflector, wherein the stream of steam losses all velocity in the first direction.

3. A steam-based faux fireplace, comprising:

a boiler configured to receive a fluid and generate steam;

a manifold configured to receive the steam from the boiler and emit the steam at an output, the output comprising an opening configured to direct the steam to create a stream of steam in a first direction; and a deflector opposed from the opening such that the directed stream of steam from the opening is configured to impinge against the deflector, the deflector configured to reduce energy and velocity of the stream of steam and deflect the stream of steam to turbulently billow about the deflector, wherein the deflector has an end and is configured to deflect the billowing steam downwardly, and then about the end of the deflector and upwardly to turbulently billow about the deflector.

4. The steam-based faux fireplace as specified in claim 3 wherein the deflector is concave and encompasses the output at least 180 degrees about the output.

5. A steam-based faux fireplace, comprising:

a boiler configured to receive a fluid and generate steam;

a manifold configured to receive the steam from the boiler and emit the steam at an output, the output comprising an opening configured to direct the steam to create a stream of steam in a first direction; and a deflector opposed from the opening such that the directed stream of steam from the opening is configured to impinge against the deflector, the deflector configured to reduce energy and velocity of the stream of steam and deflect the stream of steam to turbulently billow about the deflector, wherein the deflector has a concave inner surface opposed from the output.

6. The steam-based faux fireplace as specified in claim 5 wherein the concave surface is a circular inner surface opposed from the output such that a majority of the stream of steam is normal to the deflector.

7. A steam-based faux fireplace, comprising:

a boiler configured to receive a fluid and generate steam;

a manifold configured to receive the steam from the boiler and emit the steam at an output, the output comprising an opening configured to direct the steam to create a stream of steam in a first direction; and a deflector opposed from the opening such that the directed stream of steam from the opening is configured to impinge against the deflector, the deflector configured to reduce energy and velocity of the stream of steam and deflect the stream of steam to turbulently billow about the deflector, further comprising a pressure controller disposed between the boiler and the manifold output configured to selectively establish a pressure of the emitted stream of steam.

8. The steam-based faux fireplace as specified in claim 7, wherein the pressure controller comprises a valve configured to selectively adjust a height of the billowing steam.

9. The steam-based faux fireplace as specified in claim 8, wherein the valve comprises a variably controlled orifice.

10. A steam-based faux fireplace, comprising:

a boiler configured to receive a fluid and generate steam;

a manifold configured to receive the steam from the boiler and emit the steam at an output, the output comprising an opening configured to direct the steam to create a stream of steam in a first direction;

a deflector opposed from the opening such that the directed stream of steam from the opening is configured to impinge against the deflector, the deflector configured to reduce energy and velocity of the stream of steam and deflect the stream of steam to turbulently billow about the deflector; and a housing having a cavity, wherein the manifold and the deflector are disposed in the housing cavity, and the deflector is configured to deflect the stream of steam in the housing cavity.

11. A steam-based faux fireplace, comprising:

a boiler configured to receive a fluid and generate steam;

a manifold configured to receive the steam from the boiler and emit the steam at an output, the output comprising an opening configured to direct the steam to create a stream of steam in a first direction;

a deflector opposed from the opening such that the directed stream of steam from the opening is configured to impinge against the deflector, the deflector configured to reduce energy and velocity of the stream of steam and deflect the stream of steam to turbulently billow about the deflector; and a light configured to illuminate the billowing steam as it rises above the deflector and create a faux flame.

12. A steam-based faux fireplace comprising:

a boiler configured to receive a fluid and generate steam;

a manifold configured to receive the steam from the boiler and emit the steam at an output, the output comprising an opening configured to direct the steam to create a stream of steam in a first direction;

a deflector opposed from the opening such that the directed stream of steam from the opening is configured to impinge against the deflector, the deflector configured to reduce energy and velocity of the stream of steam and deflect the stream of steam to turbulently billow about the deflector;

a reservoir configured to hold a fluid;

a pump configured to draw the fluid from the reservoir; and wherein the manifold has a conduit configured to receive the fluid from the pump and route the fluid about the manifold and then to the boiler.

13. The steam-based faux fireplace as specified in claim 12, wherein the reservoir is positioned beneath the manifold.

14. A steam-based faux fireplace, comprising:

a boiler configured to receive a fluid and generate stem;

a manifold configured to receive the steam from the boiler and emit the steam at an output the output comprising an opening configured to direct the steam to create a stream of steam in a first direction, wherein the manifold has a wall forming the conduit along a length of the manifold, wherein the conduit is formed integral to the manifold wall such that heat in the manifold wall is configured to conductively transfer to the conduit and conductively heat the fluid; and a deflector opposed from the opening such that the directed stream of steam from the opening is configured to impinge against the deflector, the deflector configured to reduce energy and velocity of the stream of steam and deflect the stream of steam to turbulently billow about the deflector.

15. A steam-based faux fireplace, comprising:

a boiler configured to receive a fluid and generate steam;

a manifold configured to receive the steam from the boiler and emit the steam at an output, the output comprising an opening configured to direct the steam to create a stream of steam in a first direction;

a deflector opposed from the opening such that the directed stream of steam from the opening is configured to impinge against the deflector, the deflector configured to reduce energy and velocity of the stream of steam and deflect the stream of steam to turbulently billow about the deflector, comprising a first passageway configured to receive the steam from the boiler and extending from a midsection of the manifold to a first end of the manifold, and a second passageway configured to receive the steam from the boiler and extending from the midsection of the manifold to a second end of the manifold opposite the first end.

16. The steam-based faux fireplace as specified in claim 15, comprising a third passageway extending from the boiler to the first and second passageways, wherein the third passageway is higher proximate the boiler than at the first and second passageways such that liquid does not puddle in the third passageway.

* * * * *